8-107
5/13/86 XR 4,588,409 SR

United States Patent [19]
Sercus

[11] Patent Number: 4,588,409
[45] Date of Patent: May 13, 1986

[54] COLOR-CHANGING DYED PRODUCT AND PROCESS

[76] Inventor: Owen H. Sercus, 125 W. 12th St., New York, N.Y. 10011

[21] Appl. No.: 564,325

[22] Filed: Dec. 22, 1983

[51] Int. Cl.[4] ..... D06P 5/13; D06P 5/02; D06P 5/00

[52] U.S. Cl. ..... 8/403; 8/441; 8/485; 8/543; 8/638; 8/102; 8/107; 8/918; 8/642; 8/924; 8/922; 8/927; 8/928

[58] Field of Search ..... 8/403, 441, 457, 485, 8/638, 642, 102

[56] References Cited

U.S. PATENT DOCUMENTS

| | | | |
|---|---|---|---|
| 638,819 | 12/1889 | Stimpson . | |
| 1,615,205 | 1/1926 | Muelberger . | |
| 1,810,662 | 6/1931 | Kritschevsky . | |
| 2,022,413 | 11/1935 | Ellis et al. | 8/5 |
| 3,030,227 | 4/1962 | Clifford et al. | 8/478 |
| 3,125,403 | 3/1964 | Senger | 8/65 |
| 3,220,793 | 11/1965 | Parsons et al. | 8/14 |
| 3,447,888 | 6/1969 | Weisz et al. | 8/69 |
| 3,619,103 | 11/1971 | Williams | 8/14 |
| 3,934,971 | 1/1976 | Blanchard et al. | 8/485 |
| 4,314,811 | 2/1982 | Feess et al. | 8/457 |
| 4,314,812 | 2/1982 | Feess et al. | 8/457 |

FOREIGN PATENT DOCUMENTS

| | | | |
|---|---|---|---|
| 55-30450 | 3/1980 | Japan | 8/638 |
| 1060556 | 3/1967 | United Kingdom | 8/642 |

OTHER PUBLICATIONS

Mayston, R. S. Amer. Dyestuff Reporter 2/17/64, pp. 142–147.

Trotman, E. R. Dyeing & Chemical Technology of Textile Fibers, Chas. Griffen & Co. Ltd., London, 1975, pp. 514,550.

Fairchild's Dictionary of Textiles, p. 185.

*Primary Examiner*—Paul Lieberman
*Assistant Examiner*—John F. McNally

[57] ABSTRACT

Textile products comprising a cellulosic substrate are colored with two or more dyes which differ in their respective resistance to chlorine bleaches. The initial color of the textile is determined by the combined effect of the dyes. Thereafter, textile products which may be in the form of garments, bed linens, draperies, or yard goods, are treated with an aqueous solution of bleach to decolorize, to a pre-determined degree, one or more of the dyes, to thereby change the color of the textiles.

9 Claims, No Drawings

COLOR-CHANGING DYED PRODUCT AND PROCESS

SUMMARY OF THE INVENTION

This invention relates to a new textile product and specifically to a colored cellulosic textile product which can be treated employing methods which are adaptable for use either by textile mills or in home laundries to change the textile from its original color to a completely different color.

BACKGROUND

As will be readily apparent to those in the fashion industry, the ability to change easily and predictably the color of textiles in the form of garments, bed linens and other home furnishings, would be of great commercial significance. The ability to change the color of a favorite garment in one's own home would extend the range and life of the owner's wardrobe without significant cost.

The ability to effect color changes would also be of significant commercial and economic importance to textile mills and manufacturers. For example, knowing that the color of a given run of textiles produced for a particular season can be changed to colors for a following season would permit mills to establish large inventories for a longer selling season. As presently structured, the mills must dispose of their inventories of textiles in fashion colors by means of "close outs", which are often at a loss. With the ability to predictably and selectively change the colors of unsold inventory to other readily salable colors, or even to white, for printing, or redyeing, "close out" sales would become unnecessary.

The availability of textiles whose colors can be quickly and inexpensively changed would also permit smaller manufacturers to purchase two or more colors at the relatively large minimum yardage for single runs imposed by the large mills.

U.S. Pat. No. 3,030,227 describes a process in which a fabric is dyed with a dyestuff which is acid resistant and with a resin-bonded pigment susceptible to decomposition upon treatment with acid. In combination, the two coloring materials impart a certain color to the fabric. If it is desired to change the color, the fabric is treated with acid to decompose the resin-bonded pigment, leaving the fabric colored only by the acid resistant dyestuff.

The procedure of U.S. Pat. No. 3,030,227 is useful, but has a number of drawbacks. In the first place, the number of suitable dyestuffs or pigments available is rather limited so that a full range of colors is difficult to achieve. More importantly, the acids required for effecting the color change are not normally available to the consumer for use in home laundries. Finally the treatment leaves the textile with an offensive odor.

It is an object of the present invention to provide a method of changing the color of textiles, either in the form of garments and other finished products, or as piece goods, that can be practised quickly and easily using materials which are readily available to consumers.

It is a further object of the invention to provide a method of changing the color of textiles and garments which can be safely and simply practised by the consumer in the home laundry or local laundromat.

It is also an object of this invention to provide textile mills with a method of producing colored textiles which can be changed in color, or even returned to white, for printing or redyeing.

Another object of the invention is to provide textiles with the inherent capability of predetermined color change in order to permit garment manufacturers to obtain the benefit of large volume purchases from mills and thereafter vary the colors of portions of the textile to meet their seasonal inventory requirements.

DETAILED DESCRIPTION OF THE INVENTION

In about 1956 a new series of dyes termed reactive dyes began to appear on the market. These dyes, the first of which were based on a mono- or di-halo triazine nucleus,

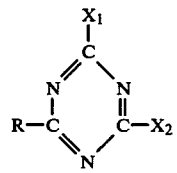

where $X_1$ is halogen, $X_2$ may be halogen or some innocuous substituent, and R is a radical including a chromophore group, are capable of reacting with a cellulosic substrate, thus actually binding the color to the substrate. Such dyes and variants thereof are now well known in the textile industry and are available from various manufacturers.

Reactive dyes differ one from another in their resistance to bleaching, and in particular, in their resistance to chlorine based bleaches such as those normally used in home laundries. Thus, for example, some typical reactive dyes have the following resistance to bleach, measured on a scale of 1 to 5 (with 5 indicating full stability to bleach under normal conditions).

| REACTIVE DYE | BLEACH RESISTANCE |
|---|---|
| Color Index Reactive Yellow 22 | 1 |
| Color Index Reactive Orange 86 | 4–5 |
| Color Index Reactive Yellow 86 | 2 |
| Color Index Reactive Orange 14 | 1 |
| Color Index Reactive Blue (conc.) 163 | 1 |
| Color Index Reactive Blue 4 | 3–4 |
| Color Index Reactive Blue 10 | 3 |
| Color Index Reactive Red 31 | 4 |
| Color Index Reactive Red 2 | 1 |
| Color Index Reactive Orange 4 | 4 |
| Color Index Reactive Brown 10 | 4 |

Bleach resistance ratings are normally available from dye manufacturers. For example, the ratings for the above dyes which are "Procion" ® dyes sold by Imperial Chemical Industries (ICI), are published by ICI.

In accordance with the present invention a cellulosic substrate is dyed with a combination of dyes, preferably reactive dyes, of different colors, at least one dye having high stability toward bleach (e.g., 4–5 on the above scale) and at least one being susceptible to decolorization upon treatment with bleach (e.g., 1–2 on the above scale). The dyed material is stable toward all treatments normally applied to colored fabrics; for example, it is stable to laundering using hot water and conventional soaps or synthetic detergents. However, when treated with conventional home bleach, for example, conventional aqueous hypochlorite solutions, the unstable dye is decolorized, leaving the stable dye to determine the color of the substrate. Thus, a complete shift in color can be accomplished using readily available materials which can normally be put to use by the consumer in the home laundry.

Certain vat dyes are also known to be stable to bleach and it is therefore possible to substitute a vat dye for the bleach stable reactive dye, in some circumstances. Preferably however both the dyes are reactive dyes.

The invention therefore comprises, in a first aspect, a colored textile material comprising a cellulosic substrate dyed with at least two dyes of different colors, one of said dyes being stable to bleach and the other being subject to decolorization by bleach.

In another aspect, the invention comprises a method of providing a textile product capable of having its color changed by domestic treatment which comprises dyeing a cellulosic substrate with two dyes, the first of which is stable to household bleach, while the other, having a different color from the first, is not.

Textile products which can be treated according to the invention range from yarns and threads to woven, nonwoven and knitted fabrics, as well as garments and other structures made from such products, provided that a portion of said yarns, threads or fabrics, is cellulosic. Such products are referred to herein as cellulosic substrates. The cellose component in the cellulosic substrate may be natural, such as cotton, linen, ramie, hemp, sisal or the like, or it may be synthetic, i.e., rayon made by the viscose, cuprammonium or other conventional process. The cellulose component may include cellulose esters such as cellulose acetate provided sufficient hydroxyl sites remain available for reaction with the reactive dye. In addition to the cellose component, the substrate may include various other textile components such as polyamide, polyester, acrylic or even polyolefin yarns or threads. Such materials may or may not be receptive to the reactive dyes and may themselves be colored in a union dyeing or cross dyeing procedure with some other species of dyestuff.

The substrate is originally dyed with the reactive dye or vat dye by any conventional method, following the instructions furnished by the dye manufacturer. For example, the dye may be applied by various continuous or batch dyeing operations, or by printing. Most reactive dyes are applied in the presence of an alkaline medium and after application are subjected to a steaming process to fix the dyes. The precise conditions will vary with the specific dyes and are readily ascertainable from the manufacturer's literature furnished with the dyestuff. By way of example, Procion® type reactive dyes are normally applied in an aqueous medium (which may be a printing paste) having a pH of between about 8.5 and about 11. Adjuvants such as thickening agents, migration control agents, mineral salts, for example sodium sulfate, and surfactants may also be in the dye mixture. The dye may be applied at a temperature of between about 20° C. and about 400° C. After a time which can range from as little as 10 seconds up to 120 minutes, the material can be steamed at 100° C. to 130° C. for from 30 seconds to about 10 minutes, washed with synthetic detergent and dried.

Vat dyes can be applied to the cellulosic substrate using established procedures on non-continuous machines or by padding methods. The vat dye pigments can be solublized in an aqueous medium by chemical reduction and then applied to the cellulosic substrate at a concentration which will produce the desired intensity of color. Thereafter, the substrate is washed in an acidified oxidizing solution to convert the dye back to the form of a water insoluble pigment and to develop the final color.

Alternatively, the vat dye may be obtained from the manufacturer in the form of the leuco compound, and the vatting step can be omitted. In this case, the dye is applied to the cellulosic substrate in aqueous solution, for example, by padding, followed by treatment to acidify and oxidize the compound in order to fix the pigment on the fabric and develop the desired color.

Where the dyes used are of the same type, the bleach stable dye or dyes and the decolorizable dye or dyes are applied together. On the other hand when different types of dyes are used, e.g., vat dyes and reactive dyes, the dyes are applied sequentially. It is of course also possible to apply two dyes of the same type sequentially.

The amount of each dye deposited is open to wide variation and is dictated by the colors desired for the textile after coloring and after the decolorizing treatment.

In order to determine the bleach stability of a particular dyestuff the following test procedure can be used:

A. A swatch of white cotton fabric, such as 100% cotton twill, or the like, is batch dyed in accordance with the instructions provided by the manufacturer of the dyestuff.

B. The dyed fabric is dried.

C. A solution of bleach containing 0.1% available chlorine is prepared. A piece of the dyed textile, weighing approximately 5 grams is placed in a container into which 100 ml. of aqueous bleach solution is added. The textile is immersed and allowed to stand for thirty minutes at 20° C. Thereafter the textile sample is removed, thoroughly rinsed and dried.

D. By visual inspection the treated piece is compared with a sample of the dyed fabric. If there is no perceptible difference, the dye is graded 5. If the fabric is white, or near white, the dye is graded 1.

In practicing the invention, when it is desired to change the color of a substrate dyed in accordance with the invention, the substrate is simply exposed to a conventional home bleach solution. Conveniently, this may be done by placing the substrate in a home washing machine of any available type, adding household bleach in the amount prescribed by the bleach manufacturer, a normal amount of any home detergent to serve as a wetting agent, and operating the machine in the usual manner. While it is believed that the above is sufficient to permit the average consumer to practice the invention, the various parameters of the treatment may be described more precisely as follows:

The substrate, such as a garment, is placed into contact with between about 5 kg. and about 10 kg. of water per kg of substrate. The water contains a conventional chlorine bleaching agent in an amount equivalent to a concentration of sodium hypochlorite of between about 0.2% and about 0.3% by weight. The precise agent used is not critical. Such readily available commercial products as Purex®, Clorox® and Javelle Water are entirely acceptable. A small amount of a detergent, say from about 0.5 to 1.0 ounces is also added. The purpose of the detergent is to wet the cellulosic fibers to accelerate the action of the hypochlorite to remove the chlorine-sensitive dye. The nature of the detergent, again, is not critical. It may be anionic, for example, an alkyl benzene sulphonate; non-ionic, such as ethylene oxide condensate; or blends of anionic and non-anionic detergents.

The color changing treatment is carried out at the temperature normally prescribed for the commercial bleaching agent. This will usually be between about 20° and about 30° C. The time of the treatment is again not critical, and may range from 10 to 60 minutes. After the treatment, the water remaining in the washing machine, or other container, with the substrate will normally appear colored. It should be noted that under the conditions of the normal home laundry, the color from the wash water, so far as it is due to reactive dye residues, will not affect other cellulosic materials which may be in the machine with the colored materials to be treated. The load may be drained, rinsed with clean water and dried. The colored garments or textile substrates will then be found to have assumed the color of the bleach stable dye (or combination of bleach stable dyes) with which they were treated when originally colored.

The invention will be further described with reference to the following specific examples which are intended as illustrative only.

EXAMPLE I

A series of samples of cotton fabric 12"×5" were pad dyed with aqueous solutions of various reactive dyes in the concentrations noted in Table I below to give a variety of different shades. The dyed fabrics were then placed in a Whirlpool® brand top loading home washing machine (about 16 gallons maximum water capacity) with sufficient white cotton garments to give a full load, and washed using approximately one cup of Tide® brand detergent and one cup of bleach (Clorox®). The machine was set on "hot". During the approximately 8 minute wash cycle, the water became dark colored. The machine continued through the following cycles following washing: spin-2 minutes; rinse-4 minutes; spin-2 minutes; rinse-4 minutes; and spin dry-6 minutes. After removal from the washing machine and drying the following changes were noted:

TABLE I

| Sample No. | Dyes | Concentration (oz/gal) | Bleach Ratings | Original Color | Treated Color |
|---|---|---|---|---|---|
| A | CI Reactive Yellow 22 | 6.02 | 1 | Orange | Rose |
| | CI Reactive Red 11 | 0.60 | 4 | | |
| B | Procion Yellow MX3RA | 1.61 | 4/5 | Dark | Light |
| | Procion Blue MX-G | 1.85 | 1 | Green | Green |
| C | CI Reactive Yellow 22 | 2.60 | 1 | Dark | Medium |
| | CI Reactive Blue 4 | 5.50 | ¾ | Green | Blue |
| D | CI Reactive Blue 4 | 3.46 | ¾ | Dark | Slate |
| | CI Reactive Red 2 | 1.41 | 1 | Purple | Blue |
| E | CI Reactive Red 11 | 1.68 | 4 | Dark | Cran- |
| | Procion Blue MX-G | 0.93 | 1 | Purple | berry |
| F | CI Reactive Yellow 22 | 2.70 | 1 | Dark | Blue-Gray |
| | CI Reactive Blue 4 | 2.60 | ¾ | Green | |
| | CI Reactive Red 11 | 0.75 | 4 | | |
| G | Procion Blue MX-G | 1.08 | 1 | Dark | Tan |
| | Procion Orange MX-2R | 1.29 | 4 | Green | |

EXAMPLE II

Eight samples of 100% cotton broadcloth, measuring approximately 6"×36", and weighing about 4 oz./sq. yard were dyed with various reactive dyes and treated as described in Example I. The results are set out in Table II:

TABLE II

| Sample No. | Dyes | Concentration (oz/gal) | Bleach Ratings | Original Color | Treated Color |
|---|---|---|---|---|---|
| H | Procion Yellow MX-8G | 0.23 | 2 | Navy | Purple |
| | CI Reactive Red 11 | 0.672 | 4 | | |
| | Procion Blue MX-G | 3.17 | 1 | | |
| I | Procion Yellow MX-3SA | 0.42 | 4–5 | Navy | Slate Blue |
| | CI Reactive Red 2 | 0.60 | 1 | | |
| | Procion Blue MX-G Conc. | 2.64 | 1 | | |
| J | CI Reactive Red 11 | 0.364 | 4 | Navy | Light |
| | CI Reactive Blue 109(s) | 4.48 | | | Purple |
| K | Procion Yellow MX-8G | 0.665 | 2 | Dark | Light |
| | Procion Blue MX-G | 0.60 | | Green | Mint |
| L | CI Reactive Red 2 | 0.03 | 1 | Navy | Dusty |
| | CI Reactive Blue 4 | 0.49 | 3–4 | | Blue |
| | Procion Blue MX-G Con. | 4.88 | 1 | | |
| M | Procion Yellow MX-3RA | 1.87 | 4–5 | Brown | Gold |
| | Procion Scarlet MX-BRA | 0.56 | 1 | | |
| | Procion Blue MX-G Conc. | 0.322 | 1 | | |

EXAMPLE III

A series of eleven samples consisting variously of cotton twill, broadcloth, poplin and denim fabric measuring approximately 6"×36" were dyed with various reactive dyes and treated as described in Example I. The fabrics ranged in weight from about 2 oz./sq. yard for the poplins and broadcloth, up to about 10 oz./sq. yard for the twill and denim fabrics. The results are set out in Table III:

TABLE III

| Sample No. | Dyes | Concentration (oz/gal) | Bleach Ratings | Original Color | Treated Color |
|---|---|---|---|---|---|
| N | CI Reactive Blue 4 | 0.66 | 3–4 | Med. Dark | Light Blue |
| | Procion Blue 4X-G Conc. | 0.10 | 1 | Blue | |
| O | CI Reactive Red 11 | 0.378 | 4 | Purple | Pink |
| | Procion Blue MX-G conc | 0.21 | 1 | | |
| P | Procion Yellow MX-3RA | 2.40 | 4–5 | Brown | Gold |
| | CI Reactive Red 2 | 0.60 | 1 | | |
| | CI Reactive Blue 4 | 0.30 | 3–4 | | |
| Q | CI Reactive Red 2 | 0.28 | 1 | Purple | Blue |
| | CI Reactive Blue 4 | 0.84 | 3–4 | | |
| R | CI Reactive Yellow 22 | 0.84 | 1 | Dark | Light |
| | CI Reactive Blue 4 | 2.00 | 3–4 | Gray | Blue |
| S | Procion Yellow MX-3RA | 0.65 | 4–5 | Red | Bright |
| | CI Reactive Red 2 | 1.00 | 1 | | Yellow |
| T | Procion Yellow MX-3RA | 0.375 | 4–5 | Dark | Medium |
| | Procion Orange MX-2R | 0.75 | 4 | Green | Brown |
| | CI Reactive Blue 4 | 1.25 | 3–4 | | |
| U | Procion Yellow MX-3RA | 0.65 | 4–5 | Dark | Light |
| | CI Reactive Red 11 | 0.80 | 4 | Red | Pink |
| V | Procion Yellow MX-3RA | 0.36 | 4–5 | Medium | Light |
| | Procion Blue MX-G | 0.17 | 1 | Dark | Avocado |

TABLE III-continued

| Sample No. | Dyes | Concentration (oz/gal) | Bleach Ratings | Original Color | Treated Color |
|---|---|---|---|---|---|
| | | | | Green | |
| W | Procion Yellow MX-3RA | 1.50 | 4–5 | Black | Brown |
| | Procion Orange MX-2R | 4.00 | 3–4 | | |
| | Procion Blue MX-G conc. | 6.50 | 1 | | |

EXAMPLE IV

Individual swatches of cotton broadcloth, measuring about 6Δ×36" were batch dyed with reactive dyes and treated in accordance with the procedure of Example I. The results are tabulated in Table IV. In Table IV the concentration is given in terms of dye (solid) actually deposited on the fabric (% by weight of fabric).

TABLE IV

| Sample No. | Dyes | Concentration % weight of fabric | Bleach Ratings | Initial Color | Final Color |
|---|---|---|---|---|---|
| AJ | Procion Blue MX-G | 4.00 | 1 | Black | Red |
| | CI Reactive Orange 14 | 1.50 | 1 | | |
| | CI Reactive Red 11 | 2.00 | 4 | | |
| AK | CI Reactive Blue 4 | 4.00 | 3–4 | Black | Blue |
| | CI Reactive Orange 14 | 1.50 | 1 | | |
| | CI Reactive Red 2 | 2.00 | 1 | | |
| AL | Procion Blue MX-G | 4.00 | 1 | Black | Yellow |
| | Procion Yellow MX-3RA | 1.50 | 4–5 | | |
| | CI Reactive Red 2 | 2.00 | 1 | | |
| AM | Procion Blue MX-G | 4.00 | 1 | Black | Orange |
| | Procion Yellow MX-3RA | 1.50 | 4–5 | | |
| | CI Reactive Red 11 | 2.00 | 4 | | |
| AN | CI Reactive Blue 4 | 4.00 | 3–4 | Black | Green |
| | Procion Yellow MX-3RA | 1.50 | 4–5 | | |
| | CI Reactive Red 2 | 2.00 | 1 | | |
| AO | CI Reactive Blue 4 | 4.00 | 3–4 | Black | Purple |
| | CI Reactive Orange 14 | 1.50 | 1 | | |
| | CI Reactive Red 11 | 2.00 | 4 | | |

EXAMPLE V

Swatches of 100% cotton twill (10 oz./sq. yard) fabric measuring 6"×36" were dyed with vat dyes. The vat dispersions were applied using the "pad-dry-chemical pad-steam-wash" process. Thereafter, the vat-dyed cellulosic substrates were further dyed with Procion reactive dyes using the procedure described in the manufacturer's instructions. The treated swatches were then cut in two, and one part of each was treated with bleach in accordance with the procedure described in Example I. Results are tabulated in Table V.

TABLE V

| Sample No. | Dyes | Concentration (oz/gal) | Bleach Ratings | Initial Color | Final Color |
|---|---|---|---|---|---|
| AP | CI Vat Blue 6 | 5 | 4–5 | Green | Blue |
| | CI Reactive Yellow 22 | 2 | 1 | | |
| AQ | CI Vat Blue 6 | 5 | 4–5 | Purple | Blue |
| | Procion Scarlet MX-3RA | 2 | 1 | | |
| AR | CI Vat Blue 6 | 5 | 4–5 | Garnet | Blue |

TABLE V-continued

| Sample No. | Dyes | Concentration (oz/gal) | Bleach Ratings | Initial Color | Final Color |
|---|---|---|---|---|---|
| | CI Reactive Red 2 | 2 | 1 | | |
| AS | CI Vat Yellow 2 | 6 | 4–5 | Orange | Yellow |
| | CI Reactive Red 2 | 0.6 | 1 | | |
| AT | CI Vat Yellow 2 | 1.7 | 4–5 | Green | Yellow |
| | Procion Blue MX-G Conc. | 1.9 | 1 | | |
| AU | CI Vat Red 10 | 6.7 | 4–5 | Purple | Red |
| | Procion Blue MX-G conc. | .6 | 1 | | |
| AV | CI Vat Red 10 | 6 | 4–5 | Orange | Red |
| | CI Reactive Yellow 22 | | 1 | | |

When blends of cotton and polyester are used, the dyed samples differ in shade from the pure cotton fabrics because the polyester fibers do not accept the vat dye or the reactive dye and therefore undergo no discernible color change. This fact can be employed to create additional ornamental effects and color changes in such cotton blends.

What is claimed is:

1. A colored textile product capable of changing color upon treatment with bleach, comprising a woven, non-woven, or knitted cellulosic fabric, uniformly dyed throughout its cross-section in every plane perpendicular to the fabric surface with at least two dyes of different colors, one of said dyes being a reactive dye or a vat dye stable to bleach and the other being a reactive dye which is subject to decolorization by bleach.

2. The product claimed in claim 1 wherein the dyes include one reactive dye stable to bleach and one reactive dye subject to decolorization by bleach.

3. A method of providing a colored textile product capable of having its color changed by treatment with bleach, which consists essentially of dyeing a woven, non-woven, or knitted cellulosic fabric throughout its cross-section in every plane perpendicular to the fabric surface, with two dyes, one of which is a reactive dye or a vat dye which is stable to household bleach, and the other of which, having a different color from the first dye, is a reactive dye subject to decolorization by bleach.

4. The method claimed in claim 3 wherein both the dyes are reactive dyes.

5. A method of providing color variability in a textive product which consists essentially of dyeing a cellulosic substrate uniformly throughout its cross-section with a first dye which is a vat dye or a reative dye stable to household bleach and with a second dye different in color from said first dye, and which is a reactive dye subject to decolorization by bleach and subsequently treating the dyed substrate with an aqueous solution of bleach.

6. The method claimed in claim 5 wherein the bleach is chlorine bleach.

7. A method of providing a colored textile product capable of having its color changed by treatment with bleach which consists essentially of dyeing a cellulosic substrate uniformly throughout its cross-section with two dyes, one of which is a vat dye which is stable to household bleach and the other of which, having a different color from the first dye, is a reactive dye subject to decolorization by bleach.

8. A method of providing a colored textile product capable of having its color changed by treatment with bleach, which consists essentially of dyeing a woven, non-woven, or knitted cellulosic fabric throughout its cross-section with two dyes, one of which is a vat dye which is stable to household bleach and the other of which, having a color different from the vat dye, is a reactive dye subject to decolorization by bleach.

9. A colored textile product capable of changing color upon treatment with bleach, comprising a woven, non-woven, or knitted cellulosic fabric, uniformly dyed throughout its cross-section with at least two dyes of different colors, one of said dyes being a vat dye stable to bleach, and the other being a reactive dye which is subject to decolorization by bleach.

* * * * *